United States Patent [19]

Åberg et al.

[11] 4,065,347

[45] Dec. 27, 1977

[54] METHOD OF PRODUCING FLUFFED PULP

[75] Inventors: Sven Ulrik Torbjörn Åberg; Sven Gunnar Bergdahl, both of Molnlycke, Sweden

[73] Assignee: Molnlycke AB, Goteborg, Sweden

[21] Appl. No.: 659,919

[22] Filed: Feb. 20, 1976

[30] Foreign Application Priority Data

Feb. 26, 1975 Sweden ..... 7502156

[51] Int. Cl.[2] ..... D21B 1/06; D21F 11/14

[52] U.S. Cl. ..... 162/26; 162/71; 162/100; 162/150; 241/28

[58] Field of Search ..... 162/100, 23, 24, 25, 162/26, 71, 75, 78, 100, 150, 158, 179; 241/28, 17, 18; 34/10; 264/121; 128/290 R, 290 P, 296

[56] References Cited

U.S. PATENT DOCUMENTS

| | | | |
|---|---|---|---|
| 3,023,140 | 2/1962 | Textor | 162/24 |
| 3,492,199 | 1/1970 | Kindron et al. | 162/71 |
| 3,556,931 | 1/1971 | Champaigne | 162/158 N |
| 3,617,439 | 11/1971 | Chapman, Jr. | 162/158 N |
| 3,627,630 | 12/1971 | Gagnon | 162/100 |

FOREIGN PATENT DOCUMENTS

| | | | |
|---|---|---|---|
| 232,954 | 2/1961 | Australia | 162/100 |

*Primary Examiner*—Richard V. Fisher
*Attorney, Agent, or Firm*—Young & Thompson

[57] ABSTRACT

The present invention relates to fluffed pulp comprising unwashed mechanical pulp with a liquid-diffusing capacity of at least 3.5 grams liquid per gram pulp per minute, a bulk of at least 18 $cm^3$/gram and a volume weight in blocks or bales of at most 0.8 grams/$cm^3$. The invention also comprises a method of producing such a fluffed pulp by means of defibrating the wood and thereafter drying the same with warm air to a dry content of 80–95% by weight without subjecting the pulp to any mechanical compression.

7 Claims, No Drawings

METHOD OF PRODUCING FLUFFED PULP

Pulp intended for dry defibration is called fluffed pulp. In order to expediate the dry defibration, fluffed pulp is generally treated so that the fiber bonds are weaker than in normal pulp.

Fluffed pulp is primarily used for the production of absorbent articles in disposible products such as diapers, compresses, etc. in which good absorbency and liquid retention properties are called for, simultaneously as the demands on the strength, softness and flexibility of the absorbent article are great. These demands are best met if the remaining amount of undefibrated particles in the starting pulp of the absorbent article is slight or if the amount of broken fibers is slight. Both of these ends are achieved to a greater extent if the fluffed pulp has weakened fiber bonds in relation to those cases in which the fluffed pulp has strong fiber bonds.

The fiber bonds in the fluffed pulp can be weakened by means of special measures taken during production of the pulp, for example, loose pressing on the wet press and/or treatment with bond-inhibiting, chemical substances.

Fluffed pulp is generally marketed in the form of roll pulp, but can at times be sold in the form of bales.

Loose pressing in the press section of a fourdrinier machine entails that a relatively slight amount of water is mechanically pressed out of the pulp and consequently must be forced out by heat into the drying section of the Fourdrinier machine. As a result, the pulp becomes more expensive as compared to the production of common paper pulp. Likewise, the addition of chemical substances also renders the product more expensive due to material and handling costs. Thus, fluffed pulp is generally 10–25% more expensive than common pulp.

A number of processes for the dry defibration of fluffed pulp are previously known. Defibration is expedited and the quality of the defibrated pulp is higher in all of these cases when the fiber bonds are weakened, that is, when expensive fluffed pulp is used.

One method of avoiding the difficulties inherent in dry defibration is to defibrate the pulp before it has been completely dried. This is done because the strong bonds between the fibers first appear when just about all of the water has been forced out of the pulp. It has been proposed that pulp be defibrated at moisture contents of 25–60% and that the pulp be thereafter dried with warm air in such a way that the fibers are given only the slightest possible opportunity to come into contact with each other or to be bonded to each other from the time the moisture content of the pulp decreases to a certain critical value and until the pulp is dry.

The most common method is, however, the production of fluffed pulp by means of common chemical pulp or softwood or hardwood or mixtures thereof being loosely pressed in the wet press and thereafter dried. Another alternative, especially for mechanical pulp intended for dry defibration, is that the pulp is dried with warm air in a partially defibrated state, so-called flash drying. In both cases, moreover, bond-inhibiting chemical substances can be added in order to reduce the strength of the fiber bonds.

However, in all of the methods of producing fluffed pulp proposed or used to date, it is unavoidable that the pulp fibers be subjected to significant mechanical compression for the purpose of forcing water out of the wet fiber network. The main reason for this is that the processes for pulp production used to date comprise treatment steps which take place or are carried out at very low pulp concentrations, 2–3% or lower. Examples of such treatment steps are screening of the pulp and pulp washing, for example, after bleaching or extractive treatment.

During concentration of a diluted pulp suspension to pulp of such dry content that is reasonably can be terminally dried with warm air, mechanical compression of the wet fiber network always takes place.

It is true that fluffed pulp is usually produced as previously described with loose pressing in the wet press section. However, the term loose pressing is used only in relation to normal pressing, i.e. pressing used in the production of common paper pulp, and should not be confused with the absence of pressing. In the industrial production of fluffed pulp, the dry content of the pulp after the pressing stage and immediately prior to the drying stage ought to be at least 35%. The need for steam, and therewith cost, increases greatly for the terminal drying of the pulp at lower dry contents and soon reaches an unreasonable level. If the pulp were produced without any pressing, the dry content prior to the drying stage would hardly exceed 15%. In normal pressing, 40% or greater dry content after the pressing stage is reached. In presently known technique, corresponding heavy compression of the pulp takes place in the flash drying process for drying fluffed pulp.

We have found that mechanical compression followed by drying permanently damages the pulp fibers. This, in turn, reduces the value of the pulp as fluffed pulp. However, pulp which is provided without any mechanical compression has superior fluffed pulp properties. We have also found a technically and economically useful method of producing the improved pulp.

The present invention relates to a fluffed pulp comprising unwashed mechanical pulp having a liquid diffusing ability of at least 3.5 grams liquid per gram pulp and minute, a bulk of at least 18 $cm^3$/gram and a weight by volume in bales or blocks of at most 0.8 grams/$cm^3$.

The invention also relates to a method of producing such pulp, which method is characterized in that wood is mechanically defibrated and thereafter dried with warm air without any mechanical compression to a dry content of 80–95% by weight. There is thus produced an unwashed pulp, which means that the production process does not comprise any extractive treatment with organic solvents or with alkali or any conventional bleaching followed by washing. Nor does the process comprise any screening of the pulp.

By means of the present invention, in which the fluffed pulp is manufactured directly from wood by means of mechanical defibration, the pulp becomes considerably less expensive to produce than previous fluffed pulp.

In the same manner, the production becomes considerably simpler and the possibilities of regulating variables during production become considerably better than in common pulp digestion.

For production, wood in the form of chips, piecss or shavings is used as starting material and defibrated in a defibrator or a refiner. The wood used can be common softwood, fir or pine, hardwood, birch, alder, aspen, etc., but the best quality for the completed pulp is obtained by means of a mixture of hardwood and softwood at a ratio of 1:1–1:10. The bonds between the fibers in different kinds of wood will, if suitable types of wood are chosen, be weaker than the bonds between fibers of the same kind of wood.

A common defibrator can be used for defibration, in which defibrator the wood in the form of chips, pieces or shavings is fed in between rotating beating discs by means of a screw, said wood forming a pulp as it is cooked with steam. Suitable defibration temperatures lie between 75° and 200° C and the best values for the final pulp have been obtained from defibrations effected at between 100° and 150° C.

The pulp is blown out of the defibrator into a cylcone and thereafter dried in a so-called flash drier without resorting to wet pulping. After the cyclone, the pulp has a dry content which is so high that the pulp can be directly flash-dried at an acceptable cost without any intermediate removal of water by means of pressing. The pulp leaves the defibrator in an extremely fluffed state, and said state is maintained during drying by means of the fibers being caused to float freely in the drying air. Drying is suitably effected to a dry content of 80–95% of the finished pulp, preferably approx. 90%, at which the risk of development of strong fiber bonds ceases.

After drying, the pulp has a very great bulk and is especially suitable for use in absorbent articles. If the conversion to absorbent products is to be carried out at some other place, the flash-dried pulp can be pressed into blocks which are stacked and packed in bales. Refluffing of the bales to a bulk which is not much lower than prior to bale pressing can be carried out if the pulp bales are pressed to a volume weight of at most 0.8 grams/cm$^3$ at a dry content of at least 90%.

Production can also be carried out in two stages so that the pulp is first defibrated and dried in a first flash-dry stage to a dry content of 60–85% by weight, and thereafter allowed to pass through a second defibrator, whereby a further defibration is obtained and possible bonds between the separate fibers are broken down. The pulp is then terminally dried in a second flash-dry stage to a dry content of 80–95% by weight.

As has been mentioned in the preamble, a treatment with bond-inhibiting chemical substances can also be carried out. The addition of chemcials can be effected by means of spraying the chips before they enter the defibrator and/or by means of adding the chemicals directly in the defibrator. Finally, the bond-inhibiting agent can also be added to the flash-dry stage or stages in the form of an aerosol. Good results have been obtained with fatty acid soaps, alkyl or aryl sulfonates, etc. A noticable effect is obtained by additions of 0.01% or less, calculated on dry pulp, but amounts of approx. 0.1% or as much as 0.5%, calculated on dry pulp, are usually used.

In many cases, it is desired that a brighter fluffed pulp be produced. A brighter pulp is obtained by means of mixing in a mechanical ground pulp, but the pulp can also be bleached during defibration by means of the addition of different bleaching agents, for example sodium sulphite, hydrogen peroxide, persulphates, etc. Preferably, these substances are added either to the wood prior to defibration or in the defibrator itself.

Defibration is also expedited if the environment in the defibrator is alkaline.

An absorbent article of dry-defibrated fluffed pulp produced according to the invention has greater bulk than an absorbent article produced from dry-defibrated conventional fluffed pulp. The superiority is especially noticable during use of the absorbent article when it has absorbed amounts of liquid. The dry-defibrated conventional fluffed pulp collapses to a fraction of its volume in the dry state when in becomes moist. Dry-defibrated fluffed pulp according to the invention, on the other hand, retains a greater proportion of its original bulk when it absorbs liquid. The bulk in the wet state is decisive for the liquid volume which a certain amount of dry-defibrated pulp can absorb. Fluffed pulp according to the invention has better liquid absorbency than conventional fluffed pulp.

The manufacturing method for fluffed pulp described herein is substantially simpler and cheaper than manufacturing methods used to date and requires a considerably smaller amount of expensive and complicated mechanical equipment with accompanying space and maintenance.

Due to the fact that the washings, screenings, dilutions to low concentrations and thickenings involved in common processes are avoided in the present invention, the amount of waste waster is reduced drastically, whereby heavy investments for purification plants are avoided and operating costs for purification disappear.

That is to say, an improved fluffed pulp is produced at reduced cost.

The invention will be disclosed in more detail below by means of a number of examples showing comparisons between fluffed pulp according to the present invention and common fluffed pulp.

EXAMPLE 1

Unbleached mechanical pulp, so-called refiner pulp, flash-dried to 88.2% dry substance content, pressed into blocks and packed in bales in a conventional manner and having a Canadian freeness of 92 and a brightness of 58.5% SCAN was treated in the following manner:

The same was fed in small proportions into a Wennberg laboratory disintegrator. After disintegration, the amount of undefibrated material, defined as pulp particles retained on a wire screen having 12 meshes per inch, was 5%.

A sample was produced from the disintegrated pulp by means of the pulp being fed into a stream of air which was led into a cylindrical glass container, the bottom of which comprised a finely-meshed net. The base area of the sample was 50 cm$^2$ and the height was 15 cm. The glass container was weighed in order to determine the bulk of the pulp. The pulp was then compressed with a pressure of 50 g/cm$^2$, after which the container was placed in a tub containing water maintained at room temperature. The level of the water was 2 cm above the bottom of the tub. The time for total wetting of the sample was determined. Subsequently, the container was lifted and surface water was drained off. The container was thereafter weighed again in order to determine the liquid retaining capacity of the pulp.

| | |
|---|---|
| bulk cm$^3$/gram | 15 |
| total wetting time, minutes | 3.1 |
| liquid retaining capacity g water/g pulp | 6.0 |

The liquid diffusing capacity, defined as absorption per amount pulp per time unit, was calculated to be:

$$\frac{6.0}{3.1} = 1.9 \text{ g water/g pulp} \times \text{minute}$$

EXAMPLE 2

Unbleached mechanical pulp, so-called thermomechanical pulp, flash-dried to 89.0% dry substance content, pressed into blocks and packed in bales in a conventional mannner and having a Canadian freeness of 215 and a brightness of 57.4% SCAN, was treated in the same manner as in Example 1. Samples were manufactured and examined in the same manner as in Example 1.

| Results: | |
|---|---|
| portion undefibrated | 5% |
| bulk $cm^3/g$ | 16 |
| total wetting time, minutes | 3.0 |
| liquid retaining capacity g water/g pulp | 6.8 |
| liquid diffusing capacity, g water/g pulp × minutes | 2.3 |

EXAMPLE 3

Chips of mainly Swedish fir were fed by means of a screw into a refiner in such a manner that, prior to refining, the chips were subjected to a preheating with steam at approx. 135° C for 3 minutes. After defibration, the pulp was blown directly from the refiner housing to a cyclone where the steam was removed, whereupon the pulp was conveyed to a flash drier and dried.

The results of three different tests were as follows:

| | a | b | c |
|---|---|---|---|
| Canadian freeness | 109 | 190 | 315 |
| brightness, SCAN (%) | 58.3 | 58.6 | 57.9 |
| dry content prior to flash-drying, % | 41.4 | 40.2 | 38.5 |
| dry content after flash-drying, % | 89.6 | 88.8 | 90.1 |

Samples were manufactured out of the dried pulp and said samples were examined in the same manner as in Example 1 .

| Results: | a | b | c |
|---|---|---|---|
| portion undefibrated | 6 | 6 | 7 |
| bulk $cm^3/g$ | 20 | 21 | 24 |
| total wetting time, minutes | 2.3 | 2.3 | 2.4 |
| liquid retaining capacity g water/g pulp | 8.1 | 8.5 | 8.9 |
| liquid diffusing capacity g water/g pulp × minutes | 3.5 | 3.7 | 3.7 |

What we claim is:

1. Method of producing fluffed pulp; characterized in that wood is defibrated and thereafter dried with warm air to a dry content of 80 -95% by weight without resorting to wet pulping or mechanical compression, thereby to produce a fluffed pulp comprising an unwashed mechanical pulp having a liquid diffusing capacity of at least 3.5 grams liquid per gram pulp and minute, a bulk of at least 18 $cm^3$/gram and a volume weight in blocks or bales of at most 0.8 $g/cm^3$.

2. Method according to claim 1, characterized in that the fluffed pulp is dried in two flash-drying stages having an intermediate terminal defibration, said fluffed pulp being dried to 60–85% by weight in the first stage and being terminally dried to 80–95% by weight dry pulp in the second stage.

3. Method according to claim 1, characterized in that defibration is carried out at a temperature of between 75° and 200° C.

4. Method according to claim 3, characterized in that said temperature is between 100° and 150° C.

5. Method of producing fluffed pulp according to claim 1, characterized in that the wood is defibrated in a refiner or a defibrator, said wood being in the form of chips, pieces or shavings.

6. Method of producing fluffed pulp according to claim 1, characterized in that defibration is carried out in the presence of a surface-active organic substance.

7. Method according to claim 1, characterized in that defibration is carried out under alkaline conditions.

* * * * *